US008490607B2

(12) United States Patent
Ghafari et al.

(10) Patent No.: US 8,490,607 B2
(45) Date of Patent: Jul. 23, 2013

(54) AUTOMOTIVE FUEL SYSTEM

(75) Inventors: C. Joseph Ghafari, Sterling Heights, MI (US); Roy Martin, North Royalton, OH (US)

(73) Assignee: Fuel Concepts of America, Inc., Sterling Heights, MI (US)

( * ) Notice: Subject to any disclaimer, the term of this patent is extended or adjusted under 35 U.S.C. 154(b) by 117 days.

(21) Appl. No.: 13/178,891

(22) Filed: Jul. 8, 2011

(65) Prior Publication Data

US 2013/0008419 A1 Jan. 10, 2013

(51) Int. Cl.
*F02M 33/00* (2006.01)

(52) U.S. Cl.
USPC ..... 123/572; 123/557

(58) Field of Classification Search
USPC ..... 123/572–574, 543–557
See application file for complete search history.

(56) References Cited

U.S. PATENT DOCUMENTS

| | | | | | |
|---|---|---|---|---|---|
| 1,602,098 | A * | 10/1926 | Burns | ..... | 123/557 |
| 1,608,018 | A * | 11/1926 | Eldred | ..... | 123/543 |
| 4,092,962 | A * | 6/1978 | Beaton et al. | ..... | 123/557 |
| 4,510,913 | A * | 4/1985 | deCelle | ..... | 123/557 |
| 5,035,227 | A * | 7/1991 | Hansen | ..... | 123/557 |
| 5,797,380 | A * | 8/1998 | Tada et al. | ..... | 123/572 |
| 7,117,859 | B1 | 10/2006 | Martin | | |
| 7,886,725 | B1 * | 2/2011 | Smart | ..... | 123/557 |
| 2004/0089277 | A1 * | 5/2004 | Shetley et al. | ..... | 123/557 |
| 2004/0200461 | A1 * | 10/2004 | Chu | ..... | 123/557 |
| 2005/0005918 | A1 * | 1/2005 | Newhouse et al. | ..... | 123/549 |

* cited by examiner

*Primary Examiner* — M. McMahon
(74) *Attorney, Agent, or Firm* — Inventa Capital PLC

(57) ABSTRACT

A PCV circuit for an internal combustion engine is modified to deliver the PCV fluid to an atomization chamber which also receives fuel from an electronic fuel injector tapped into the main vehicle fuel supply. The fuel from the injector is thoroughly vaporized in and/or immediately downstream of the chamber and conveyed to the vehicle intake manifold. A switch cuts off operation of the fuel injector at high load/high throttle setting conditions. The injector operates at a constant frequency with a selected ON time.

14 Claims, 2 Drawing Sheets

AUTOMOTIVE FUEL SYSTEM

FIELD OF THE INVENTION

The invention relates to fuel systems and more particularly to a fuel system for an internal combustion engine (ICE) having a PCV circuit or the like wherein the objective is to improve the fuel economy of the internal combustion engine.

BACKGROUND OF THE INVENTION

Positive crankcase ventilation (PCV) circuits/systems and similar vacuum intake ports are in common use in gasoline burning internal combustion engines for automobiles in the United States and elsewhere. It is well known that the purpose and function of such systems is to collect blow-by from the engine crankcase and deliver it to the intake manifold under all but high-load/high-throttle setting conditions. In and of themselves, these systems do little or nothing to improve engine efficiency or fuel economy.

U.S. Pat. No. 7,117,859 discloses a system for metering fuel through a needle valve into fluid which is diverted from an automotive PCV circuit, and thoroughly vaporizing the fuel in one or more vaporization chambers before delivering the vaporized fuel/fluid mixture to the vehicle intake. It has been found that the end result of the use of this system is a surprising and significant increase in fuel economy.

SUMMARY OF THE PRESENT INVENTION

An objective of the present invention is to provide an improved fuel system which improves ICE fuel economy wherein an electronic fuel injector is used to meter fuel from a source into a vaporization chamber which is connected into the PCV or similar circuit of an internal combustion engine in a vehicle. The use of an electronic fuel injector per se provides a number of significant advantages over the mechanical needle valve which is disclosed and claimed in the '859 patent; e.g., the electronic fuel injector is highly reliable and, more importantly, is controllable so as to be operable in one or both of two manners.

In the first manner, a control circuit is provided whereby to operate the fuel injector at a constant frequency but with an "on/off" time ratio which can be varied. In this way, the injected fuel quantity can be calibrated to engines of different displacements and fuel utilization rates. To enjoy this benefit, the control circuit is configured so as to be programmable from an external source such as a computer so as to set and fix the duration of the "ON" time. Using suitably encrypted software, this makes it difficult for persons to tamper with the system.

When operated in a second manner, the control circuit may be actively controlled by a pressure sensor or flow rate sensor in or associated with the PCV circuit to vary the "ON" time of a fixed frequency cycle during which fuel is metered into the system.

Whether using either the first or second modes of operation described above, the system provides for a shutoff function, preferably in the form of a pressure switch, which detects a high vacuum condition indicative of high load/full throttle engine operation. Since the PCV system is of little consequence under these conditions, the fuel metering injector is shut off entirely, but resumes operation after the high vacuum condition abates.

A second aspect of the invention hereinafter described is a method of operating an internal combustion engine of the type having a PCV circuit between crankcase and intake manifold wherein the method comprises the steps of injecting fuel into the fluid flowing in a PCV circuit of an operating internal combustion engine, vaporizing the fuel in the fluid and delivering the vaporized fuel to the intake manifold for consumption by the vehicle. We have found that the practice of this method causes the oxygen sensor of a conventionally equipped motor vehicle to signal the fuel delivery system computer to reduce the primary fuel flow rate to return to the 14.7:1 ratio of air-to-fuel used in the operation of motor vehicle engines today. This leads to improved engine operation and a significant improvement in fuel economy.

As with the device described in the '859 patent, the present invention has proved capable of providing surprising and substantial improvements in fuel economy for internal combustion engines of various kinds including not only those utilizing gasoline available at commercial stations but also other fuels such as ethanol, alcohol, blends of gasoline and ethanol and other bio-fuels. In addition, the invention can be used not only in conventional automobiles; but also in boats, trucks, SUV's, RV's, tractors, and other engine-driven devices.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying photographs, the latter being briefly described hereinafter. As used herein the term "PCV system" does not necessarily imply the presence of a PCV valve.

BRIEF SUMMARY OF THE DRAWINGS

The description herein makes reference to the accompanying drawings wherein like reference numerals refer to like parts throughout the several views and wherein.

DETAILED DESCRIPTION OF THE ILLUSTRATIVE EMBODIMENT

Figure 1:
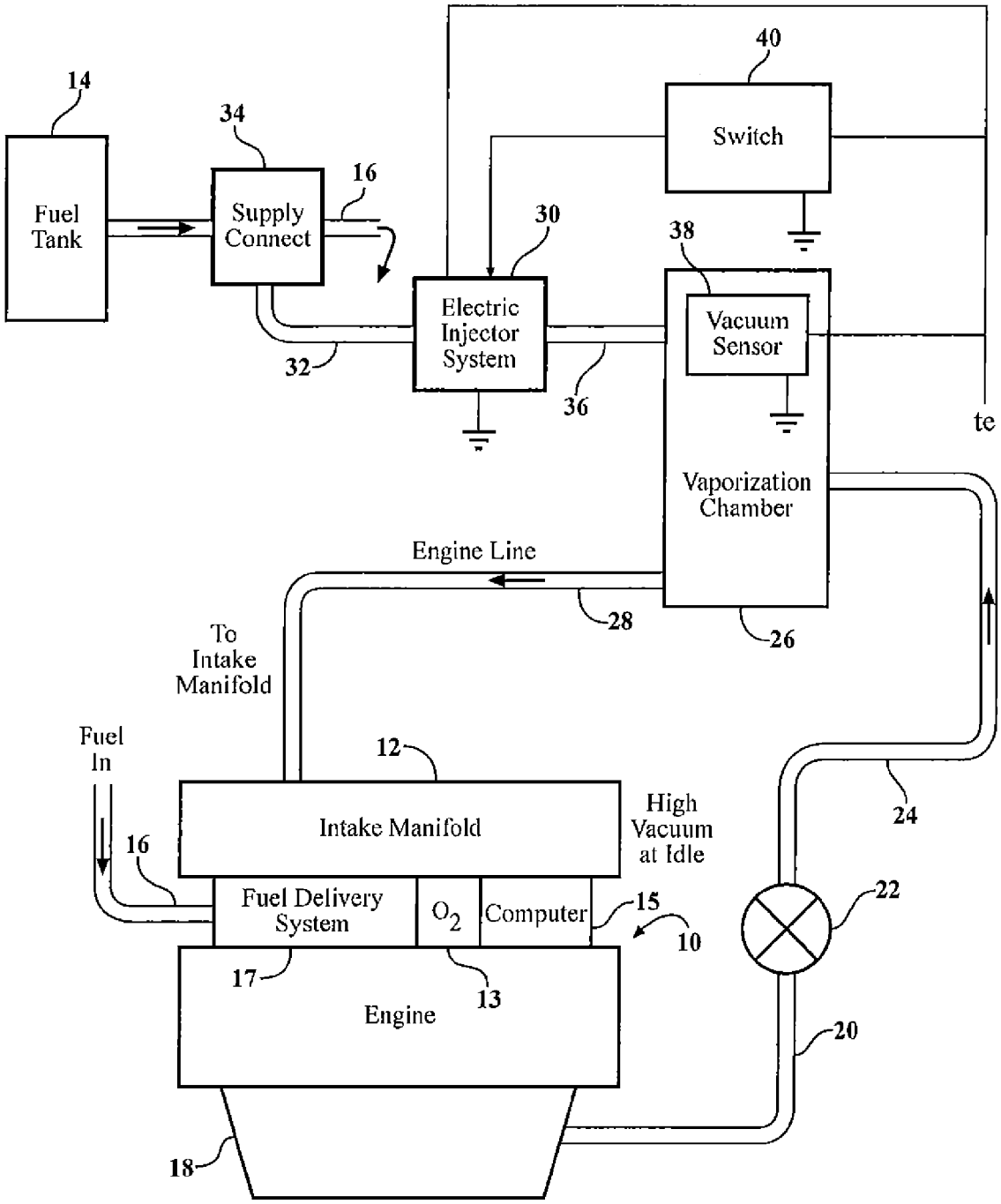
FIG. 1 is a block diagram of an internal combustion engine fuel system incorporating an embodiment of the present invention.

Referring now to FIG. 1, there is shown an internal combustion engine (ICE) 10 of the type having one or more pistons operating in cylinders (not shown) to produce power which can be used to propel an automotive vehicle in conventional fashion. The engine 10 is equipped with an intake manifold 12, fuel source 14 in the form of a conventional fuel tank, the tank having a fuel supply line 16 which runs to a fuel delivery system 17 such as a carburetor or fuel injection system, and thence to the engine 10. It will be understood that the intake manifold 12 is used primarily to provide air to the engine 10 and that the fuel delivery system 17, particularly if it is of the fuel injection type, may be physically separate from the intake manifold but is in operative association therewith so that the injected fuel eventually is taken up into and distributed within the air which is delivered to the combustion chambers of the pistons and cylinders within the engine 10.

The engine 10 is equipped with an $O_2$ sensor 13 and a fuel computer 15 which controls the air:fuel ratio via the fuel delivery system 17.

The engine 10 is also provided with a crankcase 18 which, in conventional fashion, provides a lubricant reservoir which typically splash-lubricates the crankshaft (not shown) of the engine 10. A positive crankcase ventilation (PCV) system shown here comprises a circuit 20 including a PCV valve 22 of conventional design connected between the crankcase 18 and the intake manifold 12. As stated above, not all PCV systems have the valve 22.

In accordance with the invention, the conduit 24 delivers the fluid in the PCV circuit 20 to a vaporization chamber 26 in the form of, for example, a stainless steel or fuel-safe plastic bottle, to input a hydrocarbon/air mixture of PCV fluid to the vaporization chamber 26. An output circuit 28 from the vaporization chamber runs from the bottom of the chamber 26 back to the intake manifold 12.

Mounted to and in operable association with the vaporization chamber 26 is an electronic fuel injector system 30 having a fuel supply line 32 which is tapped into the primary fuel delivery line 16 at a tap point 34. The injector system 30, which may be of the conventional piezoelectric injector type, operates to inject fuel into the vaporization chamber 26 at a high point so that such injected fuel can be thoroughly mixed into the fluid delivered to the chamber 26 by way of input line 24 and thoroughly vaporized within the chamber to the extent possible as well as downstream of the chamber in the line 28 as necessary. We have found that line 28 should be between about 30 and 145 inches in length to help in the vaporization process, the actual length depending on engine size and vacuum level.

The chamber 26 includes in operative association therewith a vacuum sensor 38 which is connected to supply a signal to a switch 40 which is electrically connected to the injector in the injector system 30 to shut the injector off at a predetermined pressure setting as sensed by the sensor 38. That setting is typically minus 5.7 in. Hg; however, the setting used in a given application may be higher or lower than −5.7 in.

Figure 2:
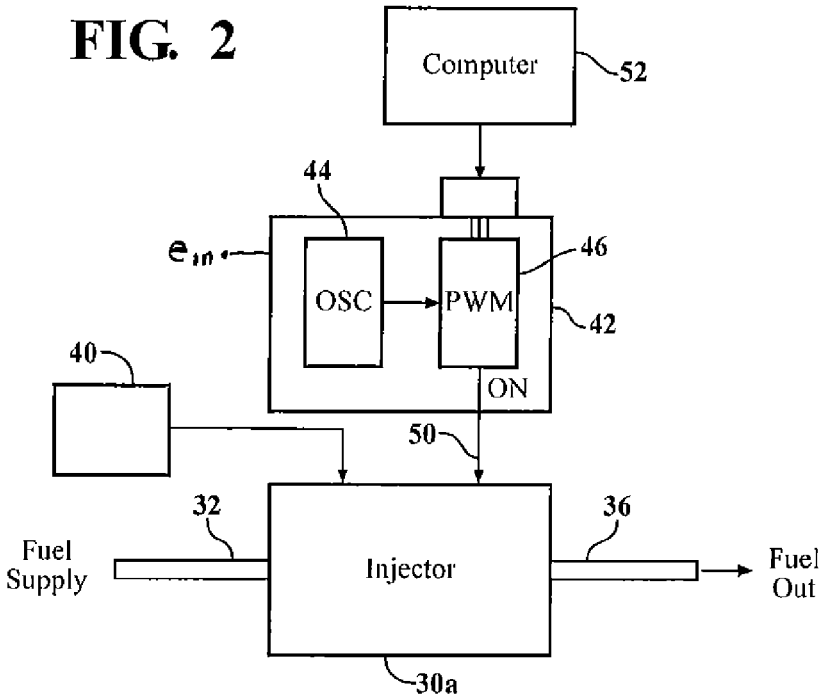
FIG. 2 illustrates a detail of one fuel injector control system which can be used in the system of FIG. 1.
Figure 3:
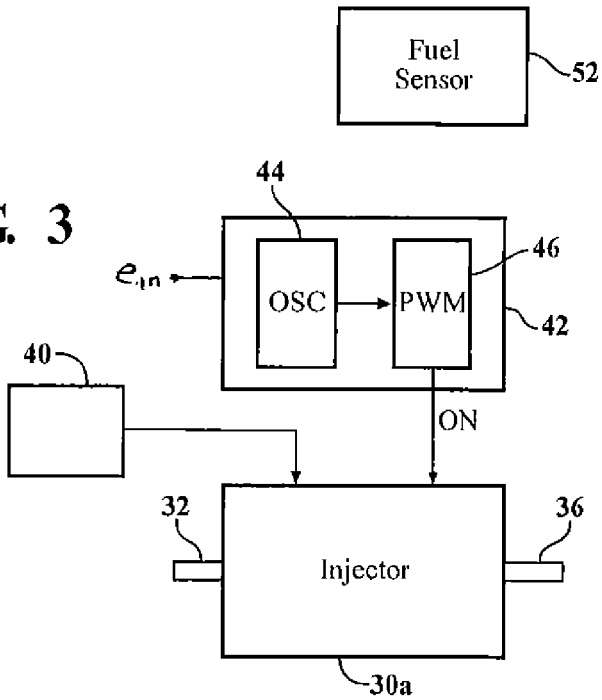
FIG. 3 illustrates a detail of a second fuel injector control system which can be used in the system of FIG. 1.
Figure 4:
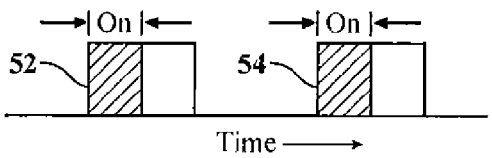
FIG. 4 is a timing diagram indicative of a pulse duration variation/modulation system.

FIG. 2 shows the fuel injector system 30 in greater detail to include a piezoelectric injector 30A having the fuel supply line 32 and the fuel output line 36 as previously described. A control circuit 42, preferably in the form of a integrated circuit, comprises a fixed frequency source 44 connected to a suitably adjusted DC source, typically available in the vehicle containing the engine 10, as well as a pulse width modulation circuit 46 of conventional design. The pulse width modulation circuit 46 is capable of adjusting the ON time of the injector 30A in a manner generally indicated by the timing diagram of FIG. 3 wherein the frequency of the fixed frequency source 44 is based on the time interval between the leading edge of the left-hand pulse 52 and the leading edge of the right-hand pulse 54 in a set of two consecutive pulses. The ON time is represented by the shaded portion of each of the pulses and can be varied between minimum and maximum lengths or durations according to the setting of the circuit 46.

The circuit 42 can be operated in either of the two different modes. In the first mode, a conventional USB computer port 48 is used to receive inputs from a digital computer so as to set the circuit 46 to produce a fixed ON time or, to put another way, a fixed ratio between the ON and OFF times of the fixed frequency injector 30A. This ON time setting is chosen in accordance with the displacement and/or horsepower range of the engine 10, smaller displacement engines having shorter ON times and larger displacement engines having longer ON times. As will be apparent to those skilled in the art, the shorter ON times of the injector 30A represent smaller quantities of fuel injected into the vaporization chamber 26 whereas longer ON times represent greater quantities of fuel injected into the vaporization chamber 26.

According to the second manner or mode of operation, the circuit 46 is connected to receive an input from a pressure sensor mounted in association with the engine PCV circuit or otherwise to actively vary the ON time according to engine operating conditions.

Whichever mode or manner of operation is chosen, the switch 40 is connected to the injector 40A to shut off all fuel injection into the vaporization chamber which forms part of the PCV diversion circuit during high load/high throttle setting conditions where the PCV circuit becomes essentially non-functional.

The invention works as described above; i.e., the fuel-rich mixture delivered from the vaporization chamber is detected by the $O_2$ sensor 13 as a departure from the 14.7:1 air-to-fuel ratio used by most manufacturers and signals the computer 15 to reduce fuel flow via the conventional fuel delivery system 17.

The invention can be supplied as a kit and used to retrofit existing vehicles or installed as OEM equipment.

A suitable device which satisfies the requirements of switch 40 is available from World Magnetics of Traverse City, Mich. and comprises a Teflon diaphragm in a polycarbonate case. The control circuit may be implemented as an Arduino nano U3.0 Gravitech-US circuit board. The port 48 may be a conventional multi-pin computer port such as a USB.

What is claimed is:

1. A fuel system for an internal combustion engine of the type having a vacuum intake circuit between a crankcase and an intake manifold comprising: a vaporization chamber; an electronic fuel injector connected to meter fuel from a source into the vaporization chamber; the vaporization chamber being connected such that, when the engine is in operation, fluid from the vaporization chamber is delivered to the engine; and a pressure switch associated with the injector to stop operation thereof at a predetermined engine operating condition wherein the condition is a high load or substantially full throttle combination.

2. The system of claim 1 further including a control circuit associated with the injector to establish the quantity of fuel metered thereby.

3. The system of claim 2 wherein the control circuit is configured to cause the injector to operate at a constant frequency of on-off times.

4. The system of claim 2 wherein the ratio of on and off times is variable.

5. The system of claim 4 wherein the ratio is varied and set to a predetermined value by externally accessed programming.

6. The system of claim 4 wherein the ratio is actively varied by pressure conditions in the PCV circuit so as to vary the quantity of metered fuel.

7. The system of claim 1 wherein the circuit is a PCV circuit and the vaporization chamber is connected to deliver fluid to the engine via the intake manifold.

8. An automotive power plant comprising: an internal combustion engine having an air intake, a crankcase and a PCV circuit connected between the crankcase and the intake; a fuel source; a vaporization chamber; an electronic fuel injector connected to meter fuel from a source into the vaporization chamber; input and output ports associated with the vaporization chamber for connection to the PCV circuit and the intake, respectively such that, when the engine is in operation, PCV fluid circulates through the vaporization chamber to carry vaporized fuel from the injector to the intake; and a pressure switch associated with the injector to stop operation thereof at a predetermined engine operating condition wherein the condition is a high load or substantially full throttle combination.

9. The system of claim 8 further including a control circuit associated with the injector to establish the quantity of fuel metered thereby.

10. The system of claim 9 wherein the control circuit is configured to cause the injector to operate at a constant frequency of on-off times.

11. The system of claim 10 wherein the ratio of on and off times is variable.

12. The system of claim 11 wherein the ratio is varied and set at a predetermined value by externally accessed programming.

13. The system of claim 11 wherein the ratio is actively varied by pressure conditions in the PCV circuit so as to vary the quantity of metered fuel.

14. A method of operating an internal combustion engine having a vacuum intake circuit including at least a PCV circuit, an intake mixture sensor and a controllable fuel delivery system comprising the steps of:

conveying fluid from the circuit into a vaporization chamber;

metering fuel into the vaporization chamber;

vaporizing the fuel metered into the vaporization chamber; and conveying the vaporized fuel and fluid from the circuit together to the engine intake at a predetermined engine operating condition being a high load or substantially full throttle combination.

* * * * *